US005644992A

United States Patent [19]

Clive-Smith

[11] Patent Number: 5,644,992

[45] Date of Patent: Jul. 8, 1997

[54] COLLAPSIBLE FLATRACK WITH RAMP END WALLS

[76] Inventor: Martin Clive-Smith, 66 Leam Terrace, Leamington Spa CV31 1BQ, England

[21] Appl. No.: 551,885

[22] Filed: Oct. 23, 1995

[30] Foreign Application Priority Data

| | | | |
|---|---|---|---|
| Oct. 24, 1994 | [GB] | United Kingdom | 9421349 |
| Oct. 11, 1995 | [GB] | United Kingdom | 9520794 |
| Oct. 16, 1995 | [GB] | United Kingdom | 9521412 |

[51] Int. Cl.[6] ..... B65D 19/00

[52] U.S. Cl. ..... 108/55.1; 108/53.1; 108/51.1; 414/537

[58] Field of Search ..... 108/55.1, 51.1, 108/53.1; 414/537, 228

[56] References Cited

U.S. PATENT DOCUMENTS

| | | | |
|---|---|---|---|
| 3,620,388 | 11/1971 | Mansson | 108/55.1 X |
| 4,240,359 | 12/1980 | Howe | 108/55.1 X |
| 4,309,013 | 1/1982 | Howe et al. | 108/55.1 X |
| 4,319,732 | 3/1982 | Godfrey | 108/55.1 X |
| 4,966,085 | 10/1990 | Howe | 108/55.1 |
| 5,306,113 | 4/1994 | Mann | 414/537 |

FOREIGN PATENT DOCUMENTS

| | | | |
|---|---|---|---|
| 456654 | 5/1949 | Canada | 414/537 |
| 1262202 | 2/1972 | United Kingdom | 108/55.1 |
| 21170185 | 1/1986 | United Kingdom . | |

*Primary Examiner*—Peter M. Cuomo
*Assistant Examiner*—Hanh V. Tran
*Attorney, Agent, or Firm*—Oppenheimer Poms Smith

[57] ABSTRACT

A platform based cargo carrier has a base (1) and posts (2) at each comer of one end. The posts are interconnected by a wall member which, with the posts, forms an end wall (4) of the carrier. Each post is pivotally mounted on the base (1) such that the wall (4) can be pivoted inwardly onto the base for stacking of carriers and outwardly away from the base to form a ramp leading onto the base. Each post can be locked into an upright position and a resilient counterbalance (11, 57) is provided to resist pivoting of each post away from its upright position.

26 Claims, 5 Drawing Sheets

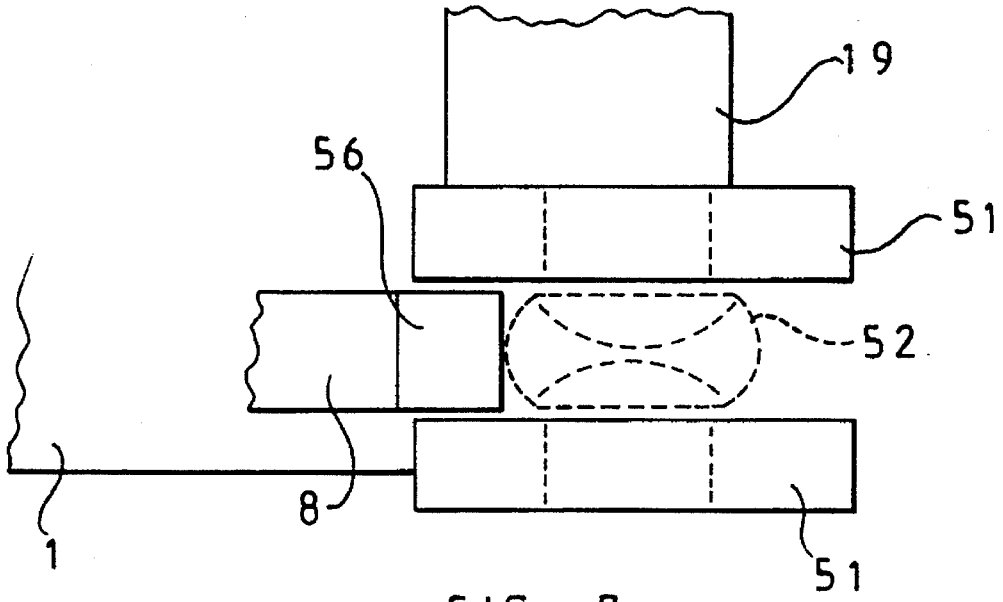
FIG 7
FIG 8
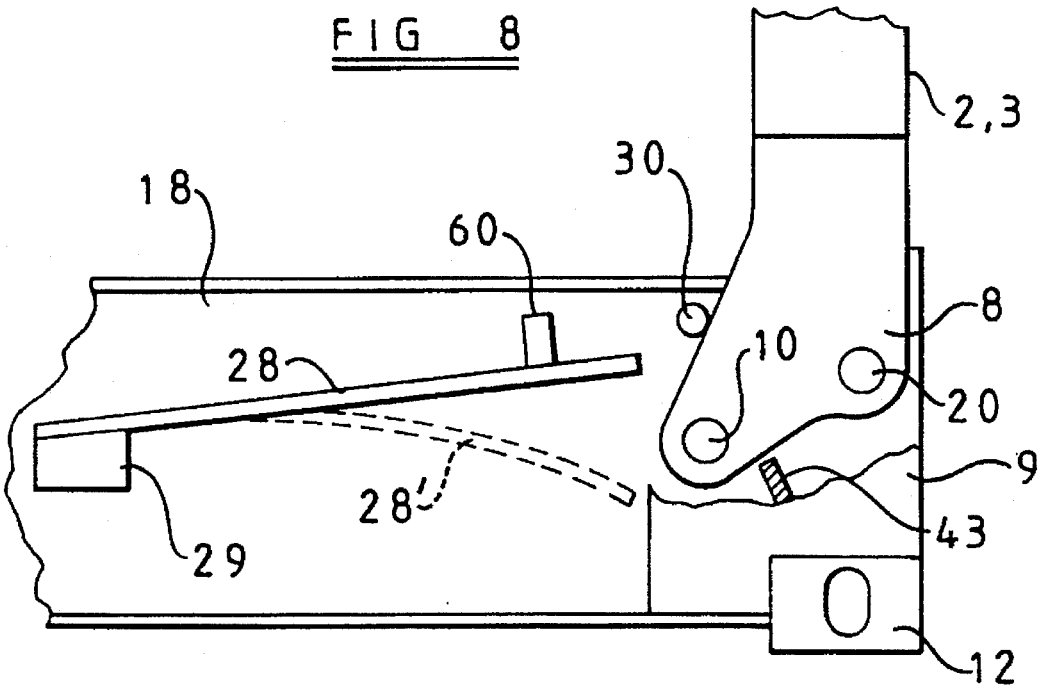

COLLAPSIBLE FLATRACK WITH RAMP END WALLS

BACKGROUND OF THE INVENTION

In the field of shipping containers there is a series of platform based cargo carriers called collapsible flatracks comprising a platform base with erect posts normally at each end though sometimes toward the middle. The posts fold down onto the base to allow the folded flatracks to be stacked one upon another for economical transport and storage. Such collapsible flatracks have been around for decades and are described in many an earlier patent. It is sometimes desired to load the flatrack from one end rather than from the side.

The posts are typically rather too heavy for man handling and so are normally filled with counterbalance springs or other resilient biassing to enable the posts to be folded and erected manually.

The walls or posts pivot on fairly substantial pivot pins, and over the years, these pins begin to corrode or seize up with dirt. Thus their removal from engagement with the post hinge elements after some time can be problematical.

During the operation of the wall, it is important that personnel and cargo are not hurt.

SUMMARY OF THE INVENTION

The present invention seeks to provide an improved platform based cargo carrier. Accordingly, the present invention provides a platform based cargo carrier having:

a base;

and at least one normally upright post pivotally attached to said base by hinge means, said post being pivotable about a first pivot axis of said hinge means between first and second positions and about a second pivot axis of said hinge means between said second position and a third position;

wherein said first and second pivot axes are formed by respective, spaced apart first and second pivot means;

wherein in said first position said post is folded inwardly onto said base, in said second position said post is an upright attitude on said base and in said third position said post is folded outwardly away from said base to form a ramp leading to said base;

and wherein said cargo carrier further comprises: abutment means for supporting said post in said second position;

locking means on said base for locking said post in said upright attitude on said base;

and counterbalance means on said base operable to resist pivoting of said post away from said second position towards said first position.

DESCRIPTION OF THE SEVERAL VIEWS OF THE INVENTION

Preferred embodiments of the invention will now be described by way of example only with reference to the following figures.

In FIG. 1 there is seen a perspective view of a typical collapsible flatrack in the erect position, dotted lines indicating the folded position of the posts.

In FIG. 2 the same collapsible flatrack has one end erect, one end folded out to the ramp position. Alternatively one wall is lifted off the base.

In FIG. 3 there is seen a detailed side elevation of a corner hinge arrangement with counterbalance spring and one part of the female hinge cut away to reveal the male part of the hinge.

In FIG. 4 there is seen the same view as FIG. 3 but with the wall folded down onto the base.

In FIG. 5 there is seen the same view as FIG. 3 but with the wall folded out from the base to form a loading ramp.

In FIG. 6 there is seen the same vie as FIG. 5 with the sill and wall sectioned.

In FIG. 7 there is seen the plan view of the folded comer of FIG. 4 illustrating the handing aperture of a folded flatrack.

In FIG. 8 (ere is seen a view similar to FIG. 3 with a different spring arrangement.

In FIG. 9 there is seen a detailed perspective view of the hinge with details of the locking device.

In FIGS. 10A, 10B, 10C and 10D there are seen details of pivot pins with improved features and illustration of their function with misaligned pivot holes.

DETAILED DESCRIPTION

Figure 1:
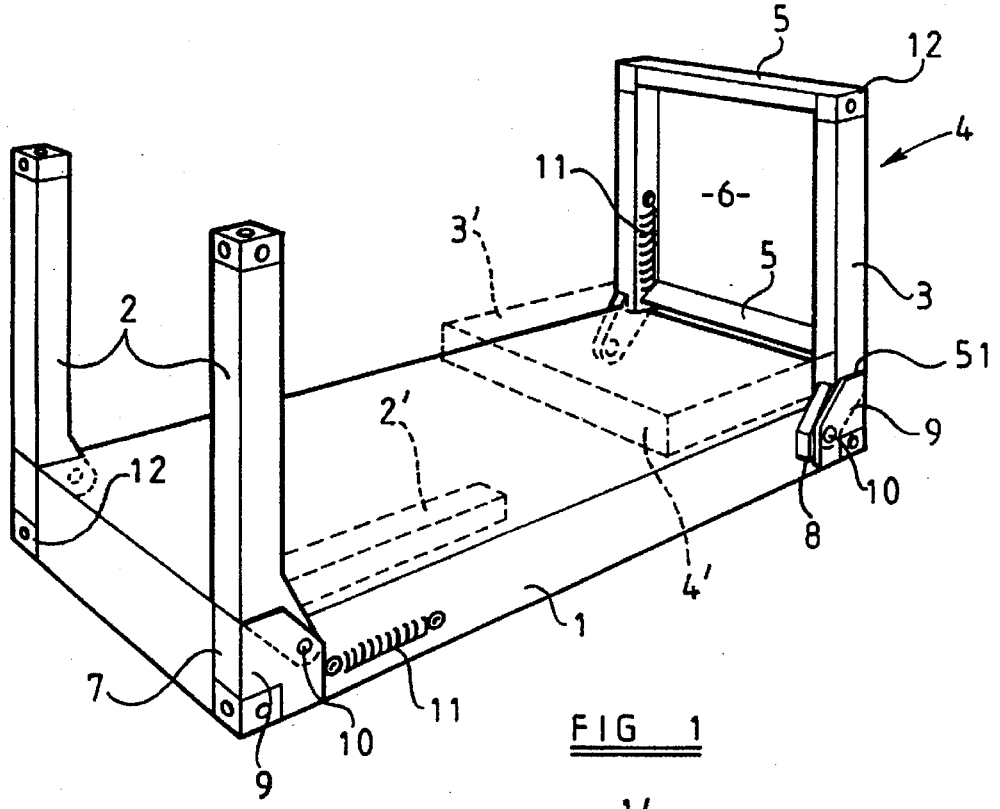

In FIG. 1 there is seen a typical collapsible flatrack having a platform base 1, and posts 2 at each comer of one end. The posts 2 can operate independently of each other. At the far end another typical arrangement is seen in which posts 3 are connected to each other and form part of a wall 4. The wall 4 includes frame members 5 and optional panel 6.

The posts 2, 3 are connected to the base 1 by hinges 7 which in this example comprise a male part 8 welded to the posts 2, 3 and a female part 9 welded to the base 1. The male 8 is pivotally connected to the female 9 via a pivot pin 10. The hinge 7 can be locked by many a known device so that the posts 2, 3 are fixed in the erect position for handling and stacking one container upon another.

The wall 4 is too heavy to fold and erect manually typically weighing almost half a ton So it is usual to connect springs suitably orientated between the base 1 and wall 4 to counterbalance the weight of wall 4 as it rotates to the folded position indicated in dotted line 4'. Such springs might comprise a tension or compression spring 11, or torsion bar springs and leaf springs 28 described later.

Once the posts 2, 3 or wall 4 are in the folded position 2'3' or 4', then the collapsible flatrack can be transported or stacked with other similar flatracks for economical transport and stowage. At each comer of the flatrack there is a comer fitting 12 to connect with known handling devices such as twistlocks. In the folded position it is typical to provide the equivalent of a comer fitting 12 comprising top plates 51 at the comer of the folded flatrack now hinge 7 once again to engage with twistlocks.

Figure 2:
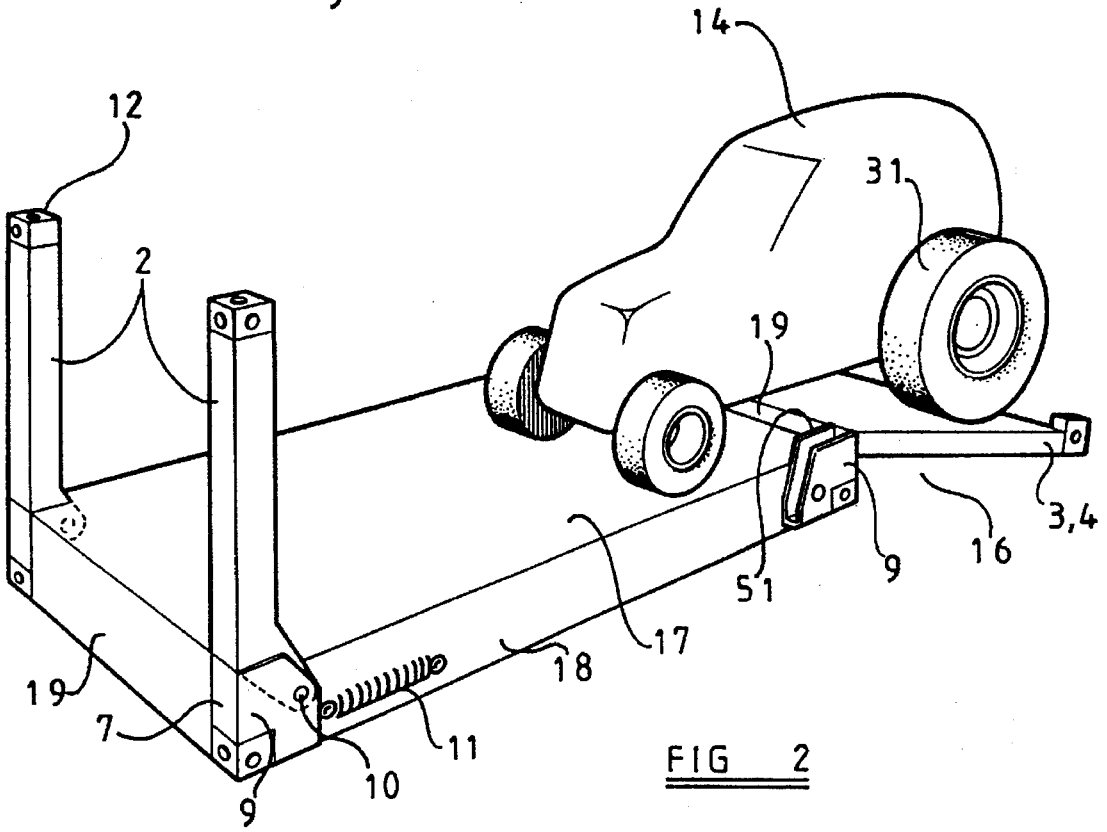

Referring to FIG. 2, it is desired that wall 4 be able to fold outward from the base to the ramp position illustrated so that vehicles 14 can be driven onto the base 1. The base 1 comprises a floor 17 often of timber supported on a peripheral frame comprising side rails 18 and end sills 19.

Figure 3:
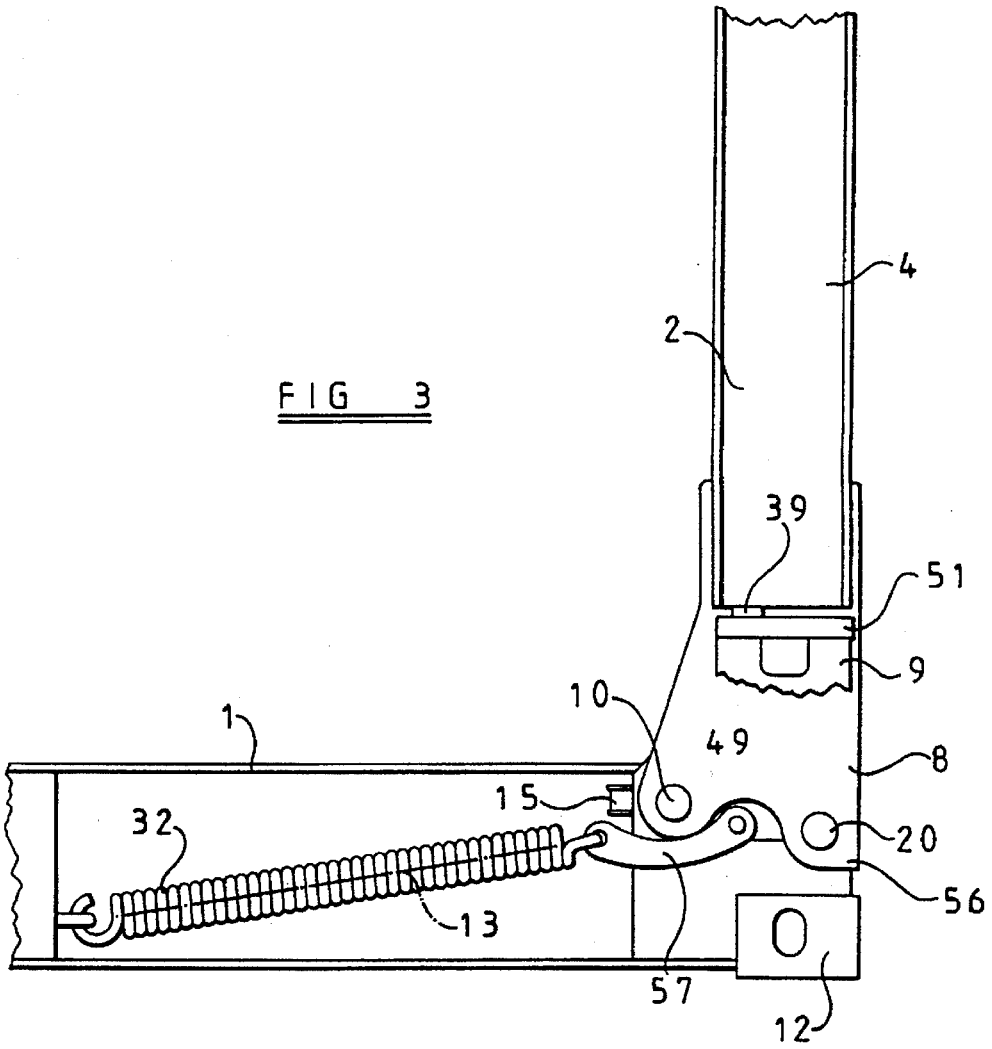

In FIG. 3 female 9 has been partly cut away on the outer part to reveal male 8. Wall 4 is in the erect position. There is a pivot pin 10 and a locking pin 20 which pass though cooperating apertures in female 9 and male 8. At a point between the vertical centre of pin 20 and pin 10 there is a stop plate 39 which abuts the top plate 51 of female 9. When one or other or pin 10 or 20 is released from engagement with male 8, the post 2, 3 can rotate about the remaining pin 20, or 10. This rotation is prevented by plate 39 abutting top plate 51 in one direction of rotation, and by force generated in tension spring 32 fixed at one end to base 1 and at the other to a link 57 which is pivoted at point 49 to the male member 8. In one embodiment spring 32 is energized by pre-stretching it or pre-loading it during manufacture so that in the position shown there is a resultant tensile force acting on link 57. The line of force of spring 32 indicated by dotted line 13 might be advantageously located to pass close by and ideally between the centre of pin 10 and pin 20 so as to not cause the post 2 to rotate about either pin 10, 20 when corresponding pin 20 or 10 has been released but hold it stable erect between stop 39 and pin 10 or 20. Thus wall 4 is able to stand relatively safely erect with one or other of pin 10, 20 released awaiting action to move wall 4 to a new position. Should both pins 10, 20 be released inadvertently, a further stop 15 can be provided to stop male 8 moving out of position in the erect position under a force from spring 32.

An alternative to stop plate 39 is plate 43 fixed to female 9 which abuts male 8 when in the erect position.

Figure 4:
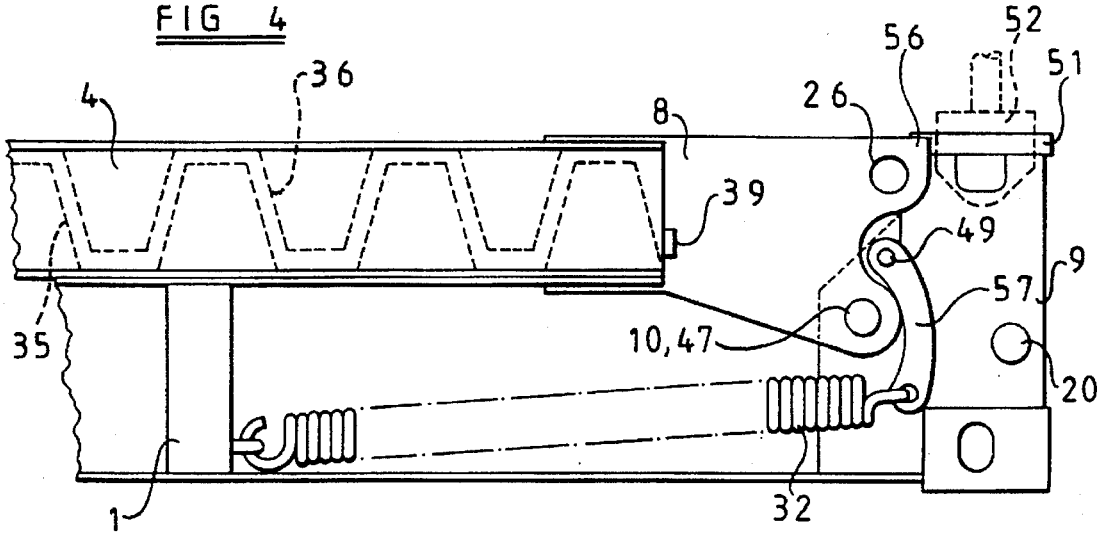

In FIG. 4 pin 20 has been released from hole 26 and thus the wall 4 can rotate about pin 10 folding it down toward the base 1. In doing so, link 57 is caused to rotate about pin 49 and at some point abut male 8 so that it appears as a projecting arm from male 8. As link 57 rotates in an arc about pin 10, tension increases in spring 32 counterbalancing the increasing weight of folding wall 4.

Figure 5:
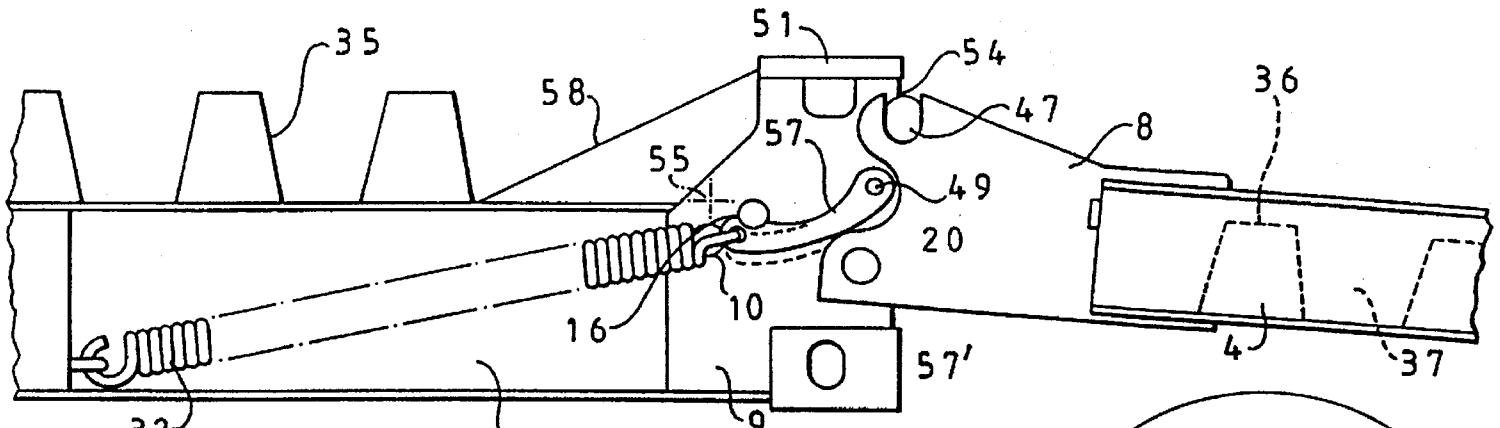

In FIG. 5 wall 4 has been folded outwards from base 1 to a ramp position. Pin 20 has been engaged when the post was in the erect position (as in FIG. 3) and pin 10 released. Link 57 being free to rotate about pin 49 has aligned with the center of spring 32 and the rotation of link 57 about pin 20 has caused spring 32 to elongate and thus again increase tension in it, thereby urging wall 4 back toward the erect position. As a means to protect spring 32 from damage by vehicles such as 14 running on top of it during loading over wall 4 in the ramp position, a ramp 58 has been provided which can be fixed or loose, here attached to the base 1. Alternatively, the location of link 57, pin 20 and other geometric factors can enable spring 32 to be located below the level of floor 17 and thus not get in the way of vehicles 14 or cargo. One such means is the provision of a stop 16 fixed to female 9 which as link 57 moves past it, the stop 16 contacts link 57 and the free position of link 57 is deflected to a lower position of dotted line 57' taking spring 32 away from the cargo space on floor 17.

One advantage of the invention is that the rolling surface of the wall 4 in the ramp position shown in FIG. 5 can be made close to the level of that of the floor 17 of base 1. There are three considerations to be illustrated. Firstly large heavy vehicles such as agricultural tractors, road tractors and small military tanks tend to have a wide wheel base typically close to the overall width of the base 1 and end wall 4. Such vehicles can easily climb up and down moderately large steps such as the step formed between top 29 of sill 19 (and/or top plate 51 ) and floor 17. The posts 2, 3 are made strong enough to support the weight of such vehicles and the posts 2, 3 are sited to align and support the wheels of large vehicles. Advantageously male 8 does not project significantly above plate 51 which might otherwise obstruct wheels 31 rolling over plate 51.

Figure 6:
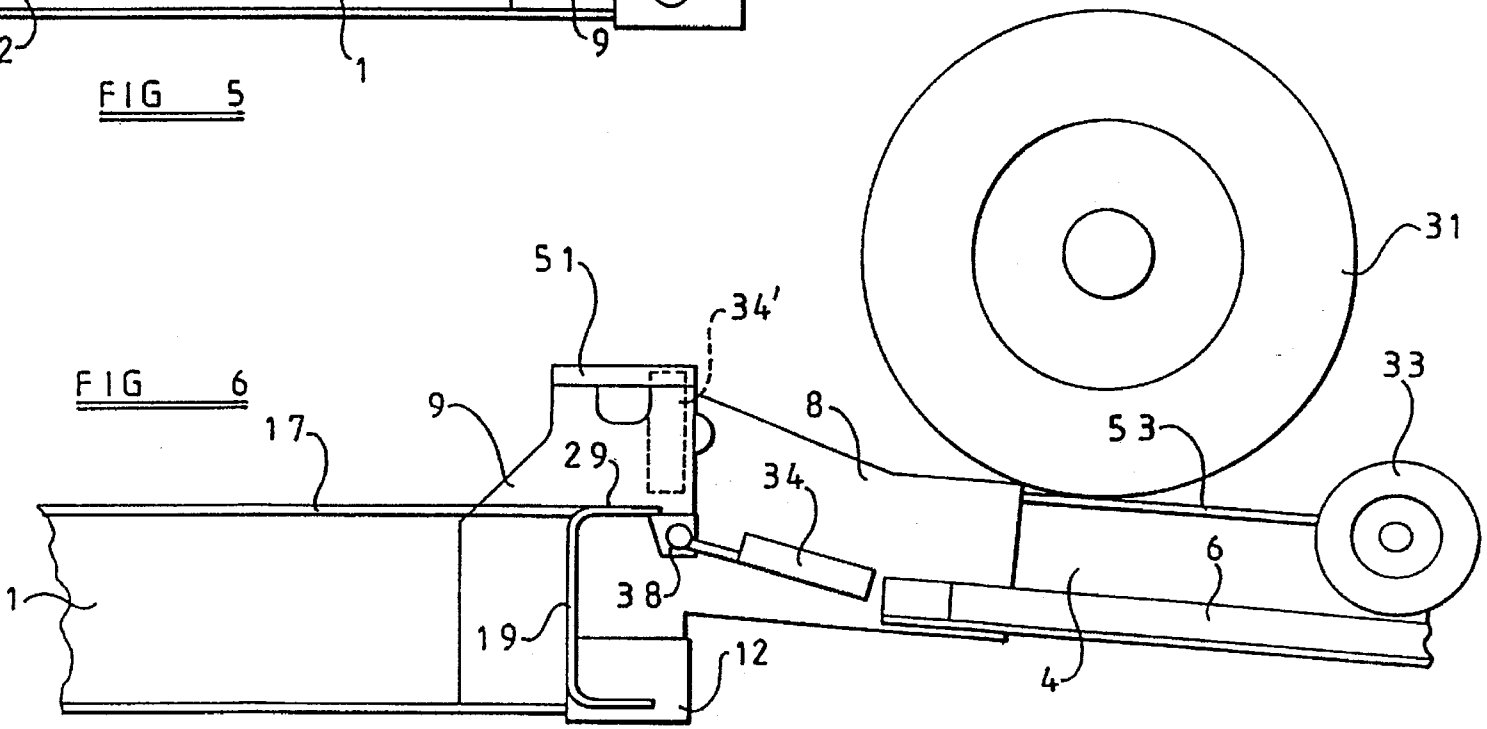

Lighter weight vehicles such as automobiles cannot navigate such steps from top plate 51 to floor 17 and their wheel base would be relatively narrow. Being again relative light weight compared to a tank for example the structural requirements of the wall 4 need not be so great. In FIG. 6 there is seen the side elevation of FIG. 5 but in section. Wheels 31 of a large heavy vehicle are riding on the top of posts 3 the wheels 33 of a smaller lighter vehicle rolling on the panel 6 between posts 3. Sill top 29 is formed lower and close to the level of floor 17, so that light weight narrow vehicles can pass up panel 6 between hinges 7 on to floor 17. Heavy vehicles with wheels 31 can drive up posts 2, 3 and over top plate 51 onto floor 17. It follows that vehicles of intermediate size might drive with one wheel at 33 and the other on the posts 3.

It can be seen that there is a gap between sill top 29 and panel 6. A means to bridge this gap may be needed and this can be done by a variety of ways. A sill extension 34 pivotally connected at hinges 38 to sill top 29 can move from an erect position in dotted line 34' to that shown. Alternatively extension 34 might be connected to wall 4. The connections might be sliding, hinged or loose which if loose the extension 34 can be stowed in a pocket or recess in base 1 or wall 4.

The length and strength of extensions 34 can be modified to suit different requirements. If a heavy vehicle is to roll on the panel 6 then extensions 34 might be devised to lay over panel 6 and assist or take over entirely the load support.

Similarly such extensions 34 might be provided to provide a rolling surfaces such as ramp 58 from plate 51 to floor 17. Where posts 2 are free of panel 6, extension 34 is a particularly useful addition for use as a ramp.

Returning to FIG. 5 should a more continuous surface be required across the width of wall 4 and floor 17 then the floor 17 can be made from slats 35. The slats 35 are shown framing transversely of base 1 but could be orientated otherwise such as longitudinally. When the wall 4 is folded on top of base 1, then there has to be receiving space 37 in the panel 6 between slats 36. The panel 6 might indeed comprise slats 36 similar to slats 35. Thus a semi- continuous surface can be formed for vehicles rolling from slats 36 to slats 35. How the slats 35, 36 align is seen in dotted line in FIG. 4. The slats 35, 36 might be formed from steel tubes, corrugated steel, timbers or the like. An advantage of transverse slats 36 is that the posts 3 can be made from solid plate the plane of the plate being vertical eating little into the cargo surface of floor 17 yet being stabilized against buckling when erect by the stability afforded by slats 36 being fixed to the face of post 3.

Alternatively load bearing surface 53 might extend across the full width to wall 4 from post to post 3.

In FIG. 7 a plan view of top plate 51 is seen here formed in two parts on either side of male 8. The elongate shape formed by top plate 51 and heel 56 forms a locating aperture for known handling devices such as twistlocks used commonly in the shipping container industry. The plan profile of a typical twistlock is shown in dotted line 52. The top plate 51 restrain the twistlock from movement laterally within the slot and the heel 56 longitudinally in one direction. A similar heel 56 at the other end of the folded flatrack provides longitudinal restraint in the other direction. One can see the position of heel 56 in FIG. 4 in side elevation lying between top plates 51, twistlock 52 indicated in dotted line abutting heel 56.

Not all collapsible flatracks may need counterbalanced walls 4 or the counterbalancing may only be needed in one direct, that being for the folding of wall 4 onto base 1. Thus the spring 32 might be a spring which is disconnected from the post as the post folds outward to the ramp position. A suitable spring 28 for this single operation is shown in FIG. 8 wherein spring 28 comprising a leaf spring which is energized by the contact of a follower 30 pressing onto the tip of the spring 28 as male 8, rotates about pin 10. However it can be appreciated that if male 8 were to rotate from the erect position shown about pin 20, then the follower 30 would move away from spring 28 and thus wall 4 be free of counterbalancing effect of the spring 28.

Figure 9:
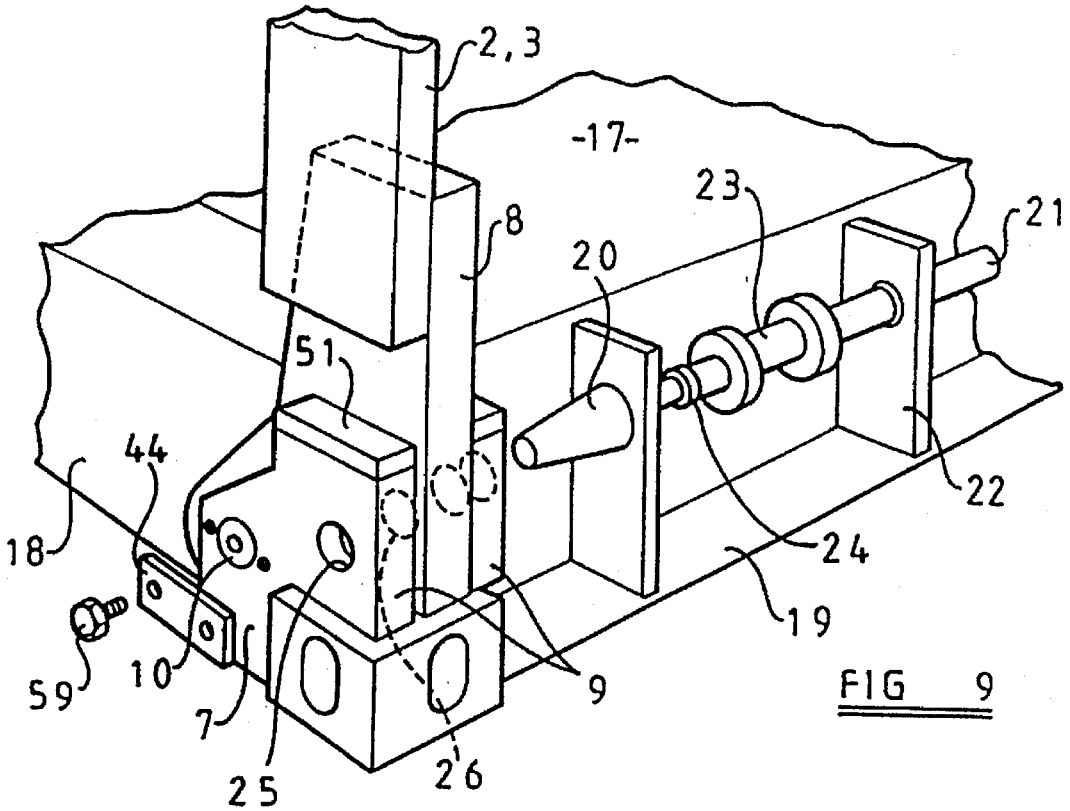
Figure 10A:
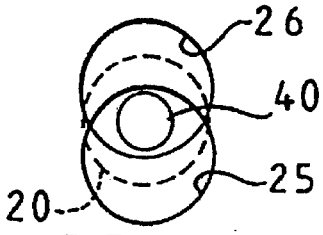

In FIG. 9 there is seen a close up perspective view of one of the hinges 7. There is seen a locking pin 20 which is partly shaped as a frustum which is fixed to a bar 21. The bar 21 carries the locking pin 20 and is mounted for sliding within apertures in plates 22 fixed to sill 19. A dumbbell shaped hammer 23 slides on bar 21 and when hammer 23 impacts stop 24 fixed to bar 21, it drives the bar 21 and thus pin 20 into holes 25, 26 formed in female 9 and male 8 thereby locking hinge 7. Because of the tapered nature of the pin 20, the holes 25, 26 can be misaligned to some degree as illustrated in FIG. 10A and the tip of pin 20 still enter both holes 25, 26 and as it is hammered in further, the pin 20 draws female 9 into correct alignment. Alternatively the conical shaped pin 20 might be tapered in some other way such as in a wedge shape and operating in rectangular apertures would achieve the same purpose of drawing misaligned apertures together. If spring 32 has high forces acting on the male 8, then holes 25, 26 are further inclined to be displaced out of alignment. So similar tapered arrangements as pin 20 would be advantageous for pin 10.

Figure 10B:
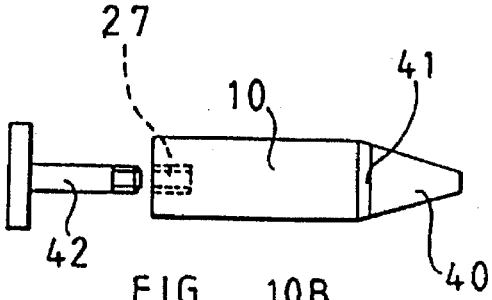
Figure 10C:
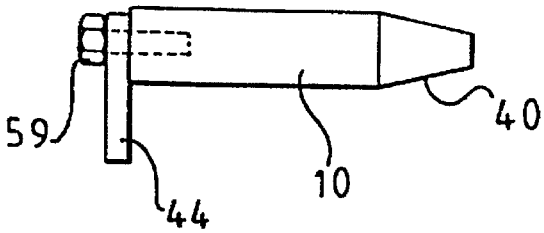

To fold the wall 4 from the base 1 to the ramp position, it is necessary to withdraw pivot pin 10 from engagement with male 8. To aid the removal of pin 10, a tapped hole 27 as seen in FIG. 10B or other connector is featured on pin 10. Thus a tool 42 might be attached to pin 10 for the withdrawal of the pin 10. Alternatively the retaining plate 44 shown removed and in suspension in FIG. 9 which is used to retain pin 10 by being screwed to female 9 by screws 59 can be fixed directly to pin 10 as seen in FIG. 10C by screw 59 to assist in the removal of pin 10.

Figure 10D:
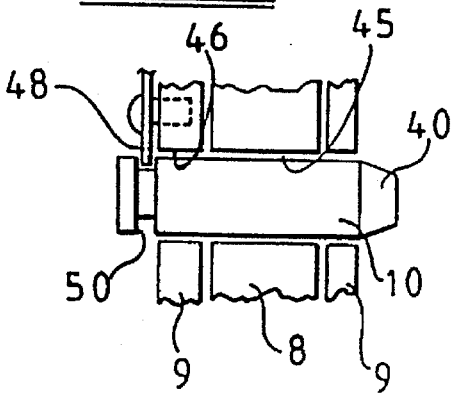

In another arrangement seen in FIG. 10D the pin 10 is seen to have an annular groove 50 cut into it. Part of male 8 and female 9 are seen in section and mounted pivotally to female 9 is a catch plate 48 which can be rotated into and out of engagement with groove 50. Thus such a plate as 48 can be devised to retain pin 10 within the hinge 7 yet be unlocked to allow release of pin 10 without need of special tools.

It is envisaged however that the withdrawal of pin 10 would be made easier under the dirty and corrosive environment of containers if the pin 10 have at least some portion of its surface tapered similar to that of pin 20 with pivot holes 45, 46 formed in male 8 and female 9 similarly tapered to seat on the pin 10 in the locked position. Alternatively as an aid to re-fitting pin 10 or 20, a larger (typically 10mm or more) shallower angled (typically 15 degrees or less) taper portion 40 may be formed greater than a typical 3 mm by 45 degree taper 41 used in the manufacture of pins 10, whereby the taper is devised specifically for drawing together substantially misaligned holes requiring some considerable mechanical advantage to draw them into alignment. It is envisaged that the pin 10 rather than being withdrawn outwards from the base (with frustum portions tapered in a direction accordingly) might be mounted with a bar and hammer system as bar 21 and hammer 23 within the base 1. Thus the pin 10 could be released within base 1 but retained and hammered back into pivotal position when the posts 2, 3 were erect.

It follows from spring 28 in FIG. 8 that wall 4 could be easily removed from the base 1 entirely by release of pin 10 and pin 20.

It is envisaged that instead of pins 10, 20 be withdrawn through holes 25, 26 and the like, the holes might be slots formed to receive a cam. In FIG. 5 hole 47 which receives pin 10 in male 8 has been slotted open at 54. When wall 4 is erect, pin 10 mounted for eccentric rotations about a point 55 can be moved into and out of engagement with aperture 47. A similar arrangement can be devised for pin 20.

If pin 20 should not be of circular section (perhaps square or rectangular with apertures 25, 26 similarly formed, then rotation to the ramp position in FIG. 5 would be awkward. Thus it is envisaged that a third pin might be engaged between male 8 and female 9 to facilitate pivotal movement of posts 2, 3 or wall 4 about the base 1 with pivot pin 10 and locking pin 20 (or other locking device) released.

Additional pins or locking devices or abutments might be used to fix the position of wall 4 in a cantilevered position out from the base so that the base 1 is effectively extended for cargo carriage should this be required.

I claim:

1. A platform based cargo carrier having:

a base;

and at least one normally upright post pivotally attached to said base by hinge means, said post being pivotable about a first pivot axis of said hinge means between first and second positions and about a second pivot axis of said hinge means between said second position and a third position;

wherein said first and second pivot axes are formed by respective spaced apart first and second pivot means;

wherein in said first position said post is folded inwardly onto said base, in said second position said post is an upright attitude on said base and in said third position said post is folded outwardly away from said base to form a ramp leading to said base;

and wherein said cargo carrier further comprises:

abutment means for supporting said post in said second position;

locking means on said base for locking said post in said upright attitude on said base;

and counterbalance means on said base operable to resist pivoting of said post away from said second position towards said first position.

2. A carrier as claimed in claim 1 wherein said counterbalance means carries a resilient biasing means for biasing said post towards said second position.

3. A carrier as claimed in claim 1 wherein said counterbalance acts to resist pivoting of said post away from said second position towards either of said first and third positions.

4. A carrier as claimed in claim 3 wherein said counterbalance means comprises at least one helical coil spring connected via one end to said base and coupled to said post by way of a linkage such that said spring acts against pivoting of said post away from said second position.

5. A carrier as claimed in claim 4 further comprising stop means on said base adjacent said linkage and positioned so as to prevent said linkage rising above an upper surface of said base during pivoting of said post.

6. A carrier as claimed in claim 4 wherein the force of said coil spring acts in a direction passing between said pivot axes.

7. A carrier as claimed in claim 4 wherein said linkage is pivoted to said post intermediate said pivot axes, such that pivoting of said post out of said second position acts on said linkage to extend said coil spring.

8. A carrier as claimed in claim 7 wherein said coil spring is pre-loaded during assembly of said carrier.

9. A carrier as claimed in claim 3 wherein said counterbalance means comprising a spring secured to said base such that pivoting of said post from said second position towards said first position causes said post to engage said spring and pivoting of said post from said first position into said second position disengages said post from said spring.

10. A carrier as claimed in claim 1 wherein said locking means comprises said first and second pivot means, said base having an upper floor surface and said first pivot means being below said upper floor surface.

11. A carrier as claimed in claim 1 wherein said abutment means and said counterbalance means cooperate to prevent said counterbalance means pivoting said post out of said second position when said locking means is disengaged.

12. A carrier as claimed in claim 11 wherein said abutment means is operable to prevent pivoting of said post between said first and second positions when said first pivot means is disengaged and to prevent pivoting of said post between said second and third positions when said second pivot means is disengaged.

13. A carrier as claimed in claim 1 wherein each said pivot means comprises a pivot pin means for pivotally engaging said post with said base.

14. A carrier as claimed in claim 1 wherein said hinge means comprises cooperating male and female parts, said post having one of said male and female parts and said base having the other of said male and female parts;

wherein said female part comprises two substantially parallel hinge plates and said male part comprises a hinge member engaged between said hinge plates;

and each said pivot means pivotally engages said female part with said male part.

15. A carrier as claimed in claim 14 wherein said male part is formed on said post.

16. A carrier as claimed in claim 15 wherein at least one of said pivot pin means is a pivot pin secured to and extending between said hinge plates and engageable in a cooperatingly shaped open ended slot in said male part such that pivoting of said post about the other of said pivot pin means away from said second position disengages said male part from said pivot pin.

17. A carrier as claimed in claim 14 wherein said hinge plates and hinge member are adapted so as to provide a locating aperture for a known handling device when said post is pivoted into its first position.

18. A carrier as claimed in claim 1 wherein each said pivot means is selectively engageable whereby engagement of said first pivot means and disengagement of said second pivot means allows pivoting of said post between said first and second positions, and engagement of said second pivot means and disengagement of said first pivot means enables pivoting of said post between said second and third positions.

19. A carrier as claimed in claim 1 wherein:

each said pivot means comprises a pivot pin means for pivotally engaging said post with said base;

each said pivot means is selectively engageable whereby engagement of said first pivot means and disengagement of said second pivot means allows pivoting of said post between said first and second positions, and engagement of said second pivot means and disengagement of said first pivot means enables pivoting of said post between said second and third positions;

and each said pivot pin is movable between a first, engaged position for enabling pivoting of said post about the associated pivot axis, and a disengaged position.

20. A carrier as claimed in claim 19 wherein at least one of said pivot pins is carried on a support rod slidably mounted on said base for movement of said pivot pin between said engaged and disengaged positions;

and wherein said rod has hammer means mounted thereon for sliding movement between first and second stops on said rod such that impact of said hammer means on said first stop drives said pivot pin towards said engaged position and impact of said hammer means against said second stop drives said pivot pin towards said disengaged position.

21. A carrier as claimed in claim 20 wherein said hammer means comprises a sleeve on said rod.

22. A carrier as claimed in claim 1 comprising a pair of said posts and a wall structure connecting the posts and extending transversely across said base thereby to form a wall.

23. A carrier as claimed in claim 22 wherein, when said wall is pivoted into said third position said wail member is spaced from said base to provide a gap therebetween;

and one of said base and said wall carries extension means for bridging said gap, said extension means being movable between a first, folded position and a second position bridging said gap.

24. A carrier as claimed in claim 23 wherein said extension means is pivotally mounted on said base.

25. A carrier as claimed in claim 24 wherein said wall member and the cooperating area of said base comprise laterally extending elongate slats arranged such that when said wall is pivoted into said first position slats of said wall engage in spaces between adjacent slats of said base.

26. A carrier as claimed in claim 25 wherein said slats are formed by corrugated sheet material.

* * * * *